US007662014B2

(12) United States Patent
Fleishman

(10) Patent No.: US 7,662,014 B2
(45) Date of Patent: Feb. 16, 2010

(54) JOINING SYSTEM FOR POLYHEDRIC MODULES

(76) Inventor: Gregg R. Fleishman, 3850 Main St., Culver City, CA (US) 90232

( * ) Notice: Subject to any disclaimer, the term of this patent is extended or adjusted under 35 U.S.C. 154(b) by 997 days.

(21) Appl. No.: 10/741,480

(22) Filed: Dec. 19, 2003

(65) Prior Publication Data

US 2004/0144041 A1 Jul. 29, 2004

Related U.S. Application Data

(60) Provisional application No. 60/435,677, filed on Dec. 20, 2002.

(51) Int. Cl.
*A63H 33/04* (2006.01)
*A63H 33/08* (2006.01)

(52) U.S. Cl. ..... 446/97; 446/85; 446/99; 446/105; 446/108; 446/111; 446/487; 52/80.1; 52/81.3; 52/582.1; 52/645; 52/DIG. 10

(58) Field of Classification Search ..... 52/80.1–81.6, 52/590, 648, DIG. 10, 582.1, 648.1, 641, 52/645; 446/11–114, 119, 490, 486, 487, 446/124; 135/15.1, 23, 25.3, 31, 33.5, 37, 135/33.4, 119

See application file for complete search history.

(56) References Cited

U.S. PATENT DOCUMENTS 2,414,716 A * 1/1947 Carson ..... 446/112
2,633,662 A * 4/1953 Nelson ..... 446/114
2,833,082 A * 5/1958 Carson ..... 446/95
3,177,611 A * 4/1965 Beck ..... 446/114
3,577,660 A * 5/1971 Kenney ..... 434/280
3,827,177 A * 8/1974 Wengel ..... 446/112
3,974,600 A 8/1976 Pearce
4,308,698 A 1/1982 Fleishman
D278,028 S 3/1985 Fleishman
4,509,879 A 4/1985 Pearce
4,551,960 A 11/1985 Fleishman
4,997,375 A * 3/1991 Heinz ..... 434/403
5,168,677 A * 12/1992 Pronsato et al. ..... 52/81.1
5,406,757 A 4/1995 Fleishman
6,173,538 B1 1/2001 Fleishman
6,676,474 B2 * 1/2004 Glickman ..... 446/126

* cited by examiner

*Primary Examiner*—Jeanette Chapman
(74) *Attorney, Agent, or Firm*—Bruce A. Jagger

(57) ABSTRACT

A joint system for joining polyhedric facet elements together. Polyhedrons have a plurality of facets. The polyhedric facet elements have facet planes that are generally congruent with the facets of the polyhedrons in which they are found. Various facet elements occupy angular relationships such that they can be joined in rigid stable joints by means of key elements where the planes of the key elements extend generally perpendicular to the planes of each of the facet elements. The joint system is suitable for inter-polyhedron joint systems where the joints include four joint elements, three of which are in the respective polyhedrons that are to be joined, and the fourth is a key element perpendicularly disposed between the other three joint elements. The joint system is likewise suitable for intra-polyhedron joint systems where there are three joint elements, two of which are in the polyhedron (in-polyhedron) and the other is a key element that extends in perpendicular relationship inter-facet between the two in-polyhedron facet elements. The intra-polyhedron embodiment of the joint system is particularly well suited to permitting polyhedron structures to be formed with alternating open and closed facets for aesthetic, structural, and other utilitarian purposes.

16 Claims, 15 Drawing Sheets

Fig. 11
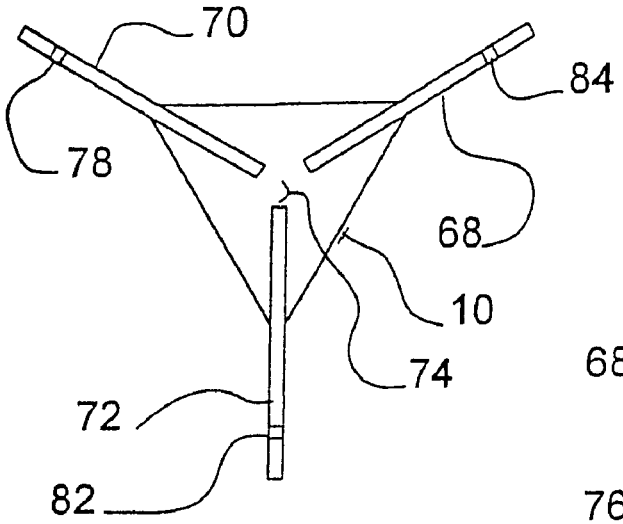
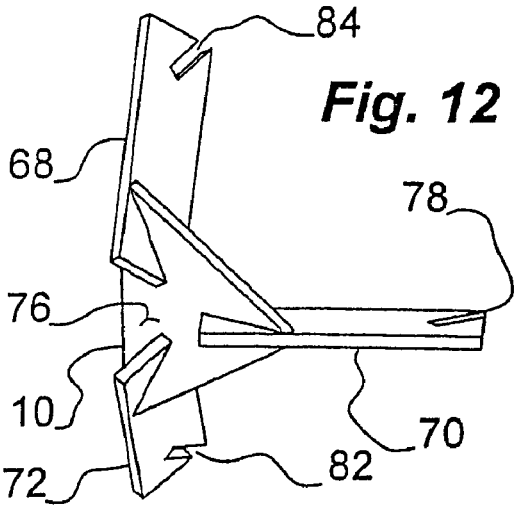
Fig. 12
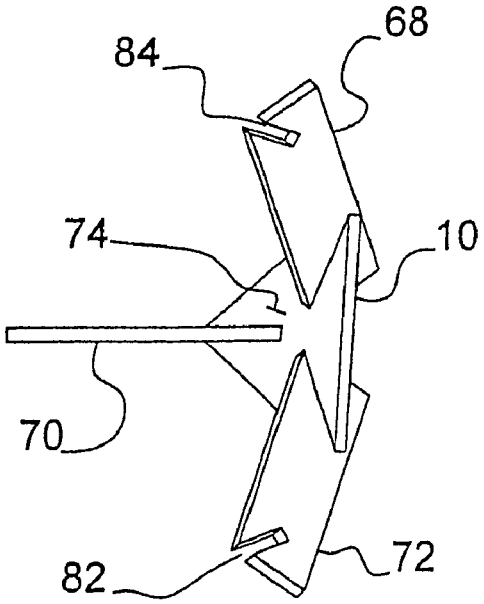
Fig. 14
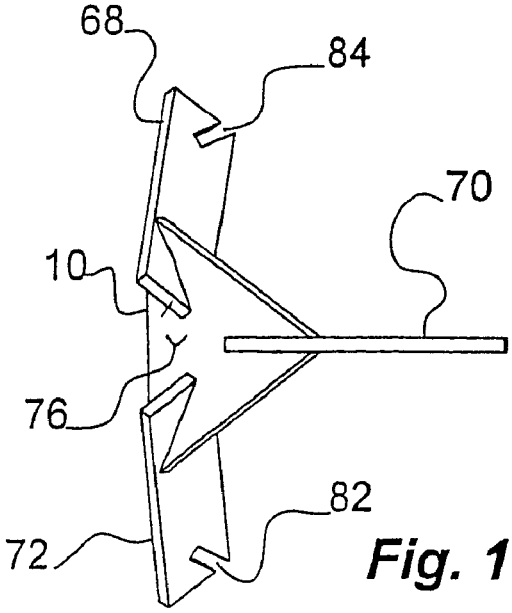
Fig. 13

Fig. 15
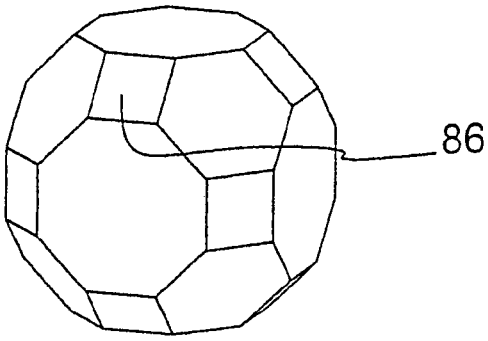
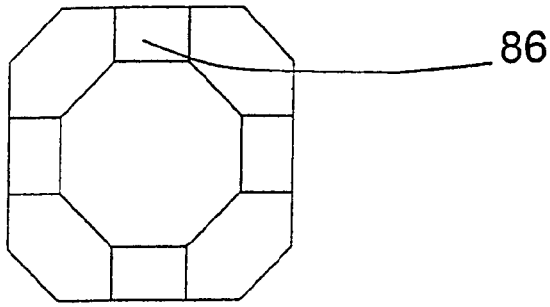
Fig. 16
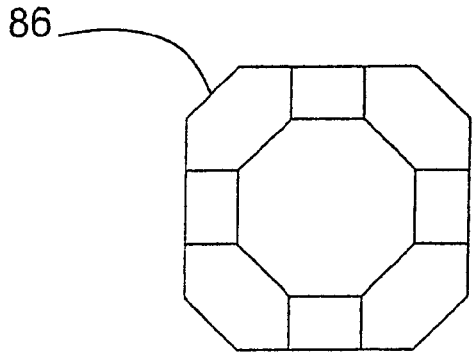
Fig. 17
Fig. 18
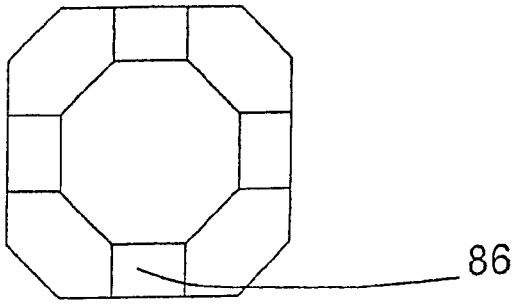

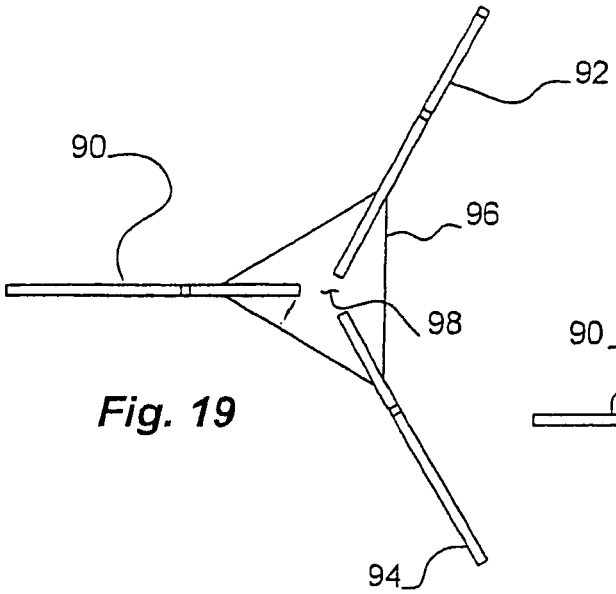
Fig. 19
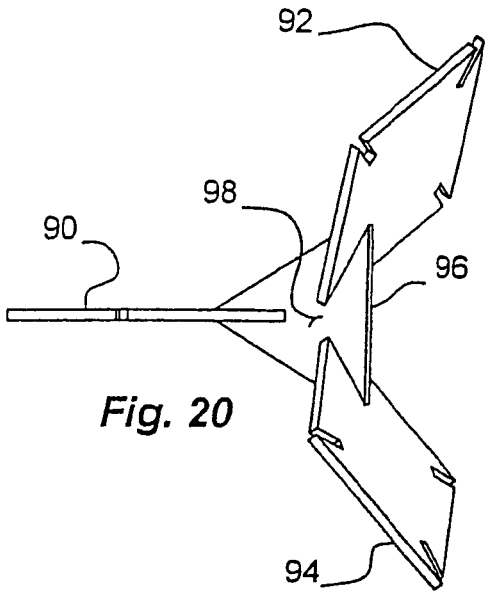
Fig. 20
Fig. 22
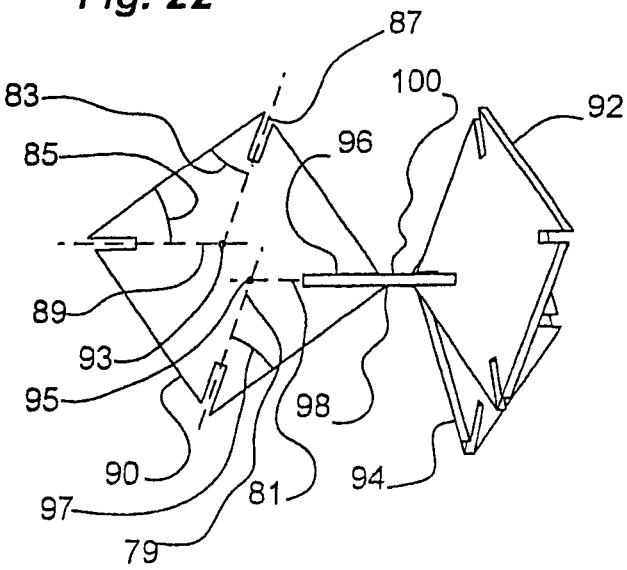
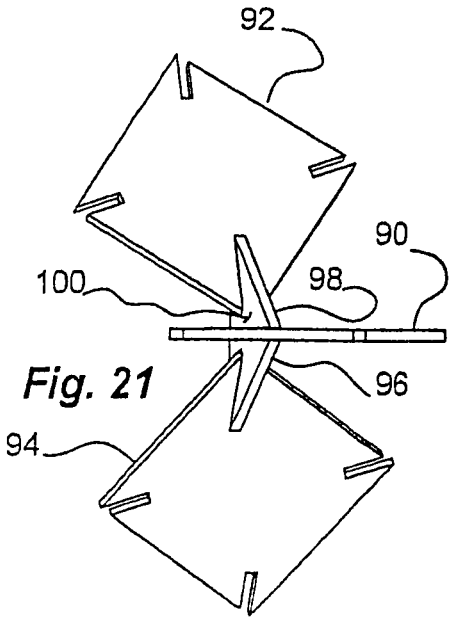
Fig. 21

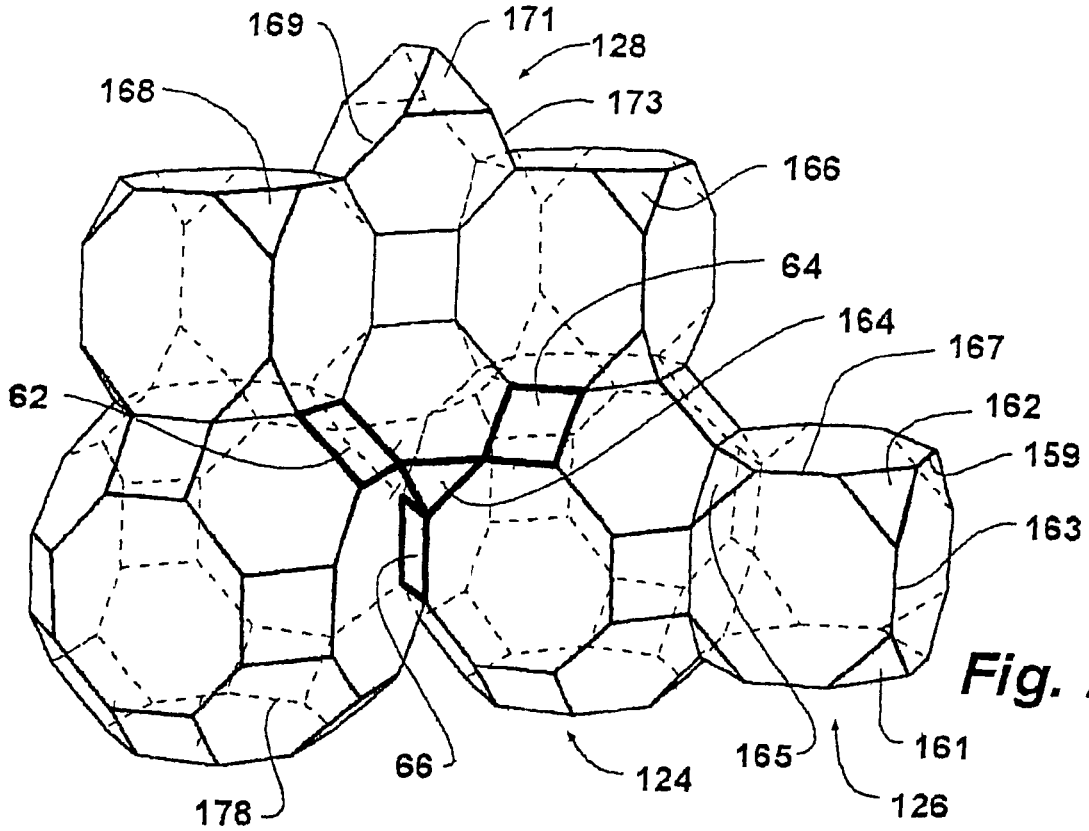
Fig. 24
Fig. 25
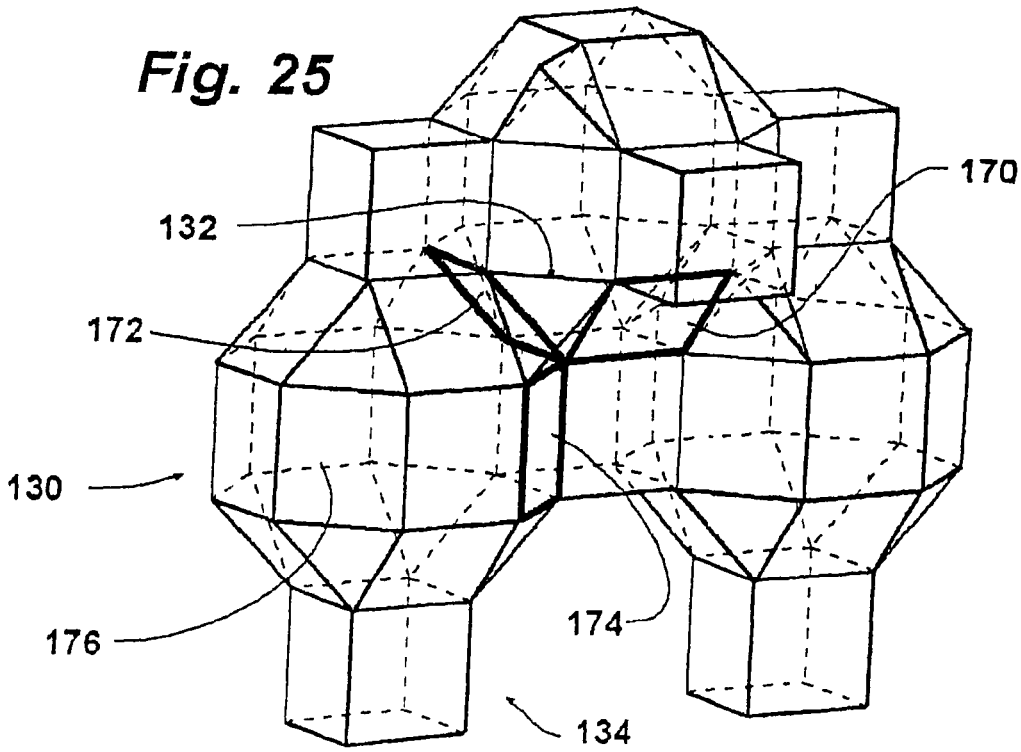

Fig. 28
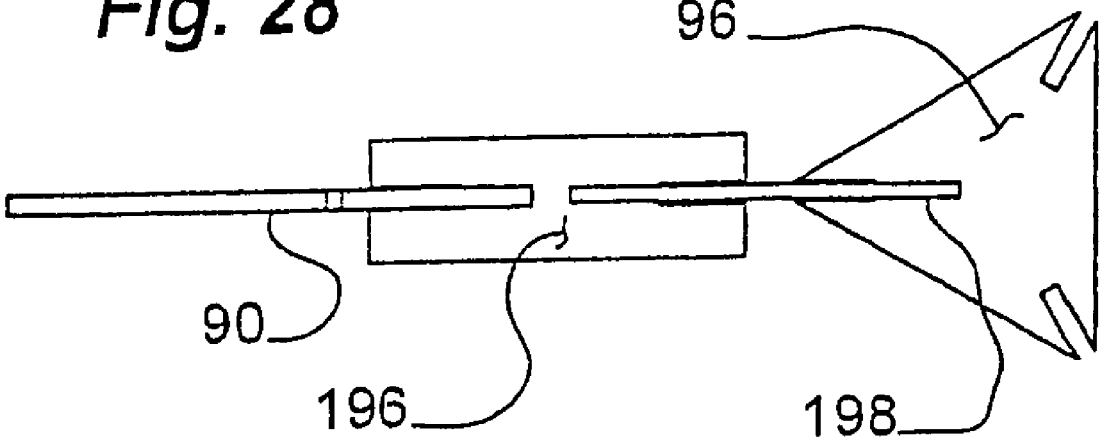
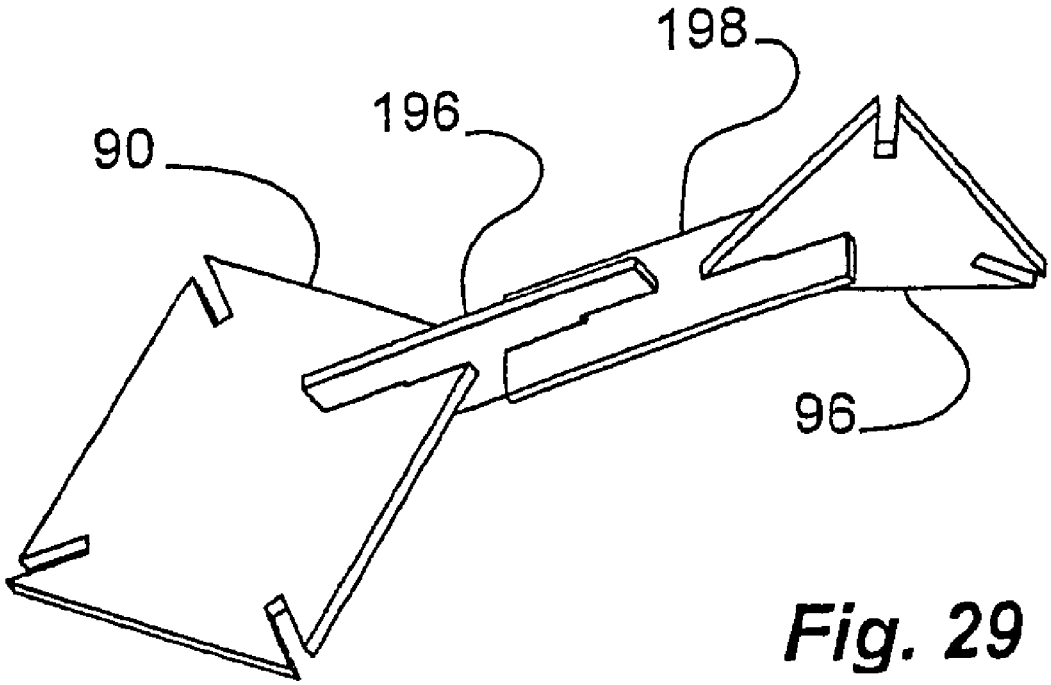
Fig. 29

Fig. 39
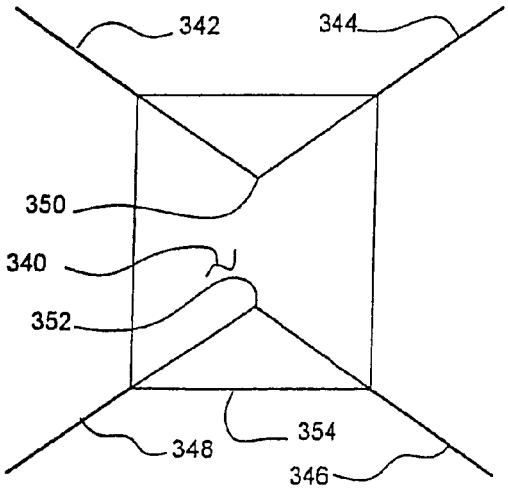
Fig. 40
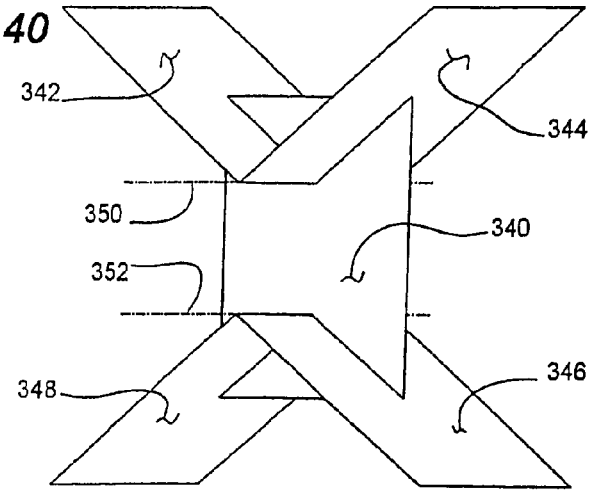
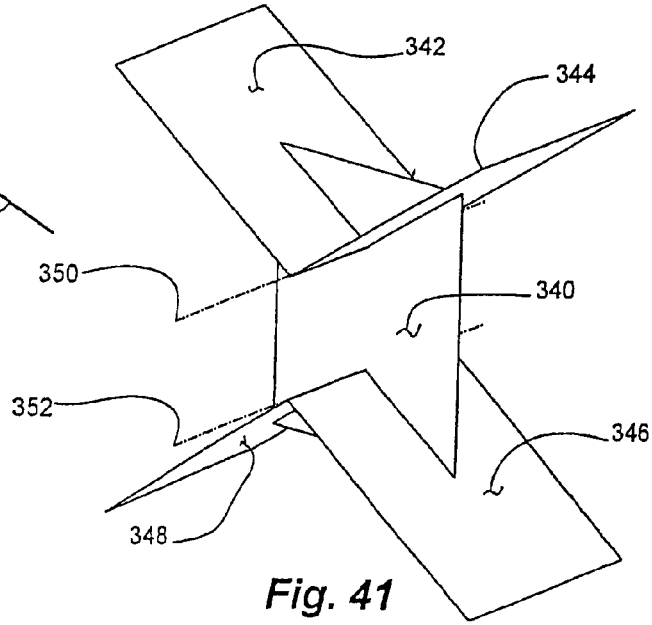
Fig. 41

Fig. 42
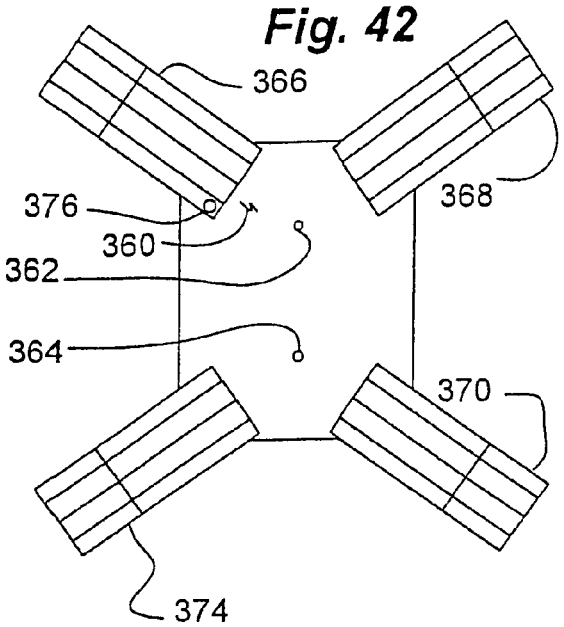
Fig. 43
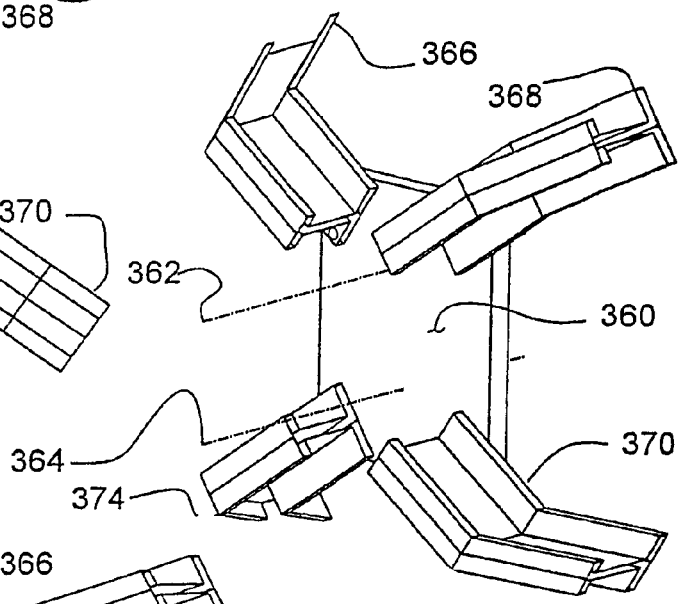
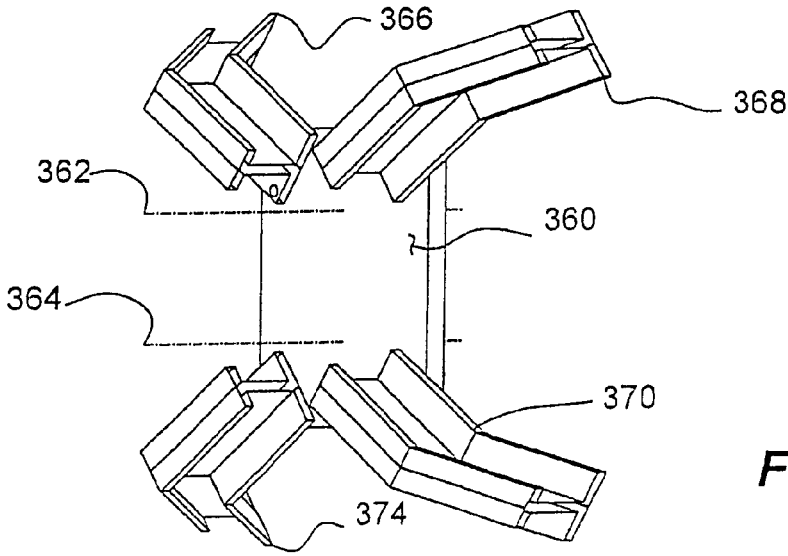
Fig. 44

JOINING SYSTEM FOR POLYHEDRIC MODULES

This application claims the benefit of U.S. Provisional Application No. 60/435,677, filed Dec. 20, 2002.

BACKGROUND OF THE INVENTION

1. Field of the Invention

The invention relates in general to joining systems for polyhedric modules and, in particular, to such joining systems wherein a key member is perpendicularly disposed between two or three facet members in a polyhedric system.

2. Description of the Prior Art

Space frame and other polyhedric structures are well known. Such structures are used in a wide range of products from toys to housing for humans. Such structures are typically composed of one or more polyhedric modules or cells. Where two or more such modules or cells are used, they must be securely joined together to make the composite structure safe and sturdy. Such polyhedra include, for example, rhombic and variously otherwise modified dodecahedrons (see, for example, Fleishman U.S. Pat. No. 6,173,538). The angular relationships for the panels in certain polyhedra are well known. See, for example, Pearce U.S. Pat. No. 3,974,600, and particularly Tables I and II, and FIGS. 3, 21a, 21b, and 21f. It is equally well known that simple polyhedra may be transformed into more complex polyhedara by slicing off the corners of the simple polyhedra—that is, by truncating their verticies. See, for example, Pearce U.S. Pat. No. 3,974,600, and particularly FIGS. 4a, 4b, and 4c.

Structural integrity and safety considerations require that the separate polyhedric modules or cells in a composite construct be securely joined together. Similar considerations dictate that individual polyhedrons should be safe, sturdy, and stable. Previous expedients for the forming of intra- and inter-polyhedron joints had often been unsatisfactory, inter alia, because of the complexity and difficulty of production and installation, and the limited functional and aesthetic options permitted by the available joints. The workers in this area had recognized the need for better joining systems for binding both individual polyhedrons and a plurality of polyhedric cells into safe integral composite constructs. Previous expedients for forming stable joints in convex polyhedrons, as described, for example, by Pearce U.S. Pat. No. 3,974,600, were likewise complex and difficult of production and installation.

These and other difficulties of the prior art have been overcome according to the present invention.

BRIEF SUMMARY OF THE INVENTION

A preferred embodiment of the joint system according to the present invention comprises the joinder, through a key element, of two or three polyhedric elements (facet elements). The polyhedric elements are in the polyhedrons themselves. The polyhedra are multi-faceted. The planes of each of the two or three elements in the polyhedrons are generally congruent with the respective facets in the polyhedrons. It has been found that the angular engagement relationships of polyhedric elements that are useful in forming joints according to the present invention exist consistently in certain families of polyhedric cells. This family of polyhedric cells with which the polyhedra or facet elements are associated includes, for example, rhombic dodecahedrons, rhombicuboctahedrons, truncated cuboctahedrons, and the like. It has also been found that the angular relationships of the planes of the key elements to one another are congruent to certain triangular facet planes of another family of polyhedric cells. This family of polyhedric cells includes, for example, octahedrons, cuboctahedrons, truncated cubes, tetrahedrons, truncated tetrahedrons, and the like.

Joints according to the present invention lend themselves to use in constructing these polyhedrons with alternating open and closed facets. Thus, for example, in a truncated cuboctahedron with rectangular, hexagonal, and octagonal facets, the rectangular facets can have solid structural panels congruent therewith (closed facets) while the octagonal and hexagonal facets are open. In, for example, a rhombicuboctahedron with triangular facets, rectangular facets, and square facets, the triangular and square facets can be open. The open facets enhance the appearance of the structure and provide multiple aesthetic and utilitarian options. The open facets are available for use as, for example, windows or doors. Having open facet makes it easier to construct.

According to one embodiment of the present invention, two polyhedrons, of the same or a different form, are selected to be joined into a composite structure through a four member inter-polyhedron joint system. The two polyhedrons are abutted against one another so that they share a common closed facet. The plane of one of the polyhedra elements in the joint system is generally congruent with this common facet (a common polyhedra element). Of the two remaining polyhedra elements in the joint system, one is in the first polyhedron and with its plane generally congruent with a facet of that polyhedron, and the second is in the second polyhedron and with its plane congruent with a facet of the second polyhedron. The polyhedra elements themselves are usually planar, but can be concave, convex, waved, or the like, if desired. In forming the joint, the key element is disposed between the three polyhedra elements. The final positions of the three polyhedra elements are typically fixed by the geometry of the polyhedra cells in the construct. The final position of the key member is likewise fixed by the positions of the polyhedra elements. According to the present invention, the angular relationships between the elements in the joint structure are such that the planes of the three elements in the polyhedrons all extend generally perpendicular to the plane of the key element and are arrayed generally symmetrically around the key element. The key element has a key axis extending generally perpendicular to the plane of the key element. The planes of the three elements in the polyhedrons all generally project radially from the key axis. If the planes of the three polyhedra elements are projected towards one another they generally intersect at and include the key axis. Typically, in order to securely join two polyhedrons, two to four joints are constructed, each of which shares the same common polyhedra element. There is a polyhedra element joining axis that extends in each of the polyhedra element planes, and there is a key element joining axis that is generally congruent with each polyhedra element joining axis in the assembled configuration. Thus, there are three key element joining axes in the key element, one for each joint. The key elements in all of the inter-polyhedron joints are preferably identical except where the structure transitions to a different form, such as, for example, a supporting base.

According to a further embodiment of the present invention, strong stable intra-polyhedron joints are easily and simply formed within a single convex polyhedron through the use of a key element perpendicularly engaged by and between two polyhedra elements. This joint structure requires only three engaged members for its construction. As with the embodiment of the joint system for joining two polyhedra together (inter-polyhedron joint), the intra-polyhedron joint is formed with the plane of the key element extending generally perpendicular to the respective planes of the two mating polyhedra elements, and the planes of the polyhedra elements are generally congruent with the respective facets of the polyhedron. Each of the polyhedra elements in an intra-polyhedron joint typically joins two to four key elements. Each polyhedra element has a polyhedra element plane and at least one polyhedra element axis extending generally perpendicular to the polyhedra element plane. There is also a polyhedra joining axis associated with each joint that generally extends in the plane of the polyhedra element. When the joint is assembled, the polyhedra element joining axis is generally congruent with an associated key element joining axis. The key elements throughout the intra-polyhedron joint system are preferably identical except where the structure transitions to a different form such as, for example, a supporting base.

In both inter- and intra-joint systems two key members are typically arrayed radially around each polyhedra element axis at an included obtuse angle of about 109.5 degrees (109.476). If the planes of the two key elements are extended towards one another they generally intersect at and include one of the polyhedra element axes. The planes of the key elements generally extend at an angle of about 35.25 degrees (35.262) to the included edge (real or virtual) of the associated polyhedra element. For purposes of orientation the included edge is considered to be the edge that faces the 109.5 degree vertex. Since the polyhedra elements are generally, but not always, rectangular, there is an adjacent edge (real or virtual) of the rectangular polyhedra element that extends at an angle of about 54.75 degrees (54.738) to each polyhedra joining element axis. The pair of polyhedra joining axes along this adjacent edge also intersect, but they form a vertex of about 70.5 degrees. There is a polyhedra element edge that faces this 70.5 vertex, but for purposes of orientation, this is referred to herein as an adjacent edge. The included edge of the polyhedra element faces either a square or octagonal open space in the preferred polyhedrons. The planes of the two key elements, when extended to intersect with the associated polyhedra element axis, together with the included edge (real or virtual) of the polyhedra element, form an isosceles triangle with an obtuse angle of about 109.5 degrees and two acute angles of about 35.25 degrees each.

According to one embodiment, the joint system is assembled together by slidably interengaging straight slots in the polyhedra elements with mating straight slots in the key element. In one simple embodiment, each of three uniformly radially arrayed straight slots in the inter-polyhedron key member is adapted to slidably interengage with a mating slot in one of the other three elements to form a rigid connection. The engagement between the three elements in the intra-polyhedron embodiment is likewise by way of sliding mutual engagement between straight mating slots formed perpendicular to the planes of the elements they are formed in. Because the elements of the joint structure in both the inter- and intra-polyhedron embodiments engage one another at right angles, the slots are easily formed by straight perpendicular cuts without the need for complicated tooling or difficult set ups. The simple inter- and intra-polyhedron embodiments of the joint structures, according to the present invention, are strong and stable without the need for further reinforcing expedients. Alternatively, other joining methods can be used as may be appropriate to the materials of construction. For example, metal panels can be bolted or welded together without interpenetrating one another provided the required perpendicularity is provided. Structural adhesives, and the like, can be employed, if desired. Separate fastening elements such as, for example, bracket members, rivets, screws, bolts, and the like, can be employed to secure the polyhedra elements to the key members, as may be appropriate to the materials of construction. The joint elements can be composed of various construction materials including, for example, wood, concrete, lightweight concrete, plastics, plastic composites, aluminum, steel, other metals, and the like. The joint elements can be formed utilizing conventional forming procedures including, for example, molding, casting, sawing, and the like. The perpendicular nature of the key elements permits the construction of very efficient strength to weight designs. Structural materials are very efficiently used. This permits close control and optimization of the structural design. Variations in the size of the polyhedra elements congruent with the facets of a polyhedron can be achieved, for example, by the use of splice elements.

The present joint system does not require the maintenance of unrealistically close tolerances in its construction. Conventional construction equipment in the hands of competent craftsmen is all that is necessary to produce a solid, safe structure. The key elements for the inter-polyhedron embodiments are preferably all identical except in transition areas. This permits them to be made at a factory location under good quality control and shipped in bulk to a construction site for assembly. Tolerances of one to two tenths of a degree and five to twenty thousandths of an inch can be maintained under factory production conditions. Assembly does not require keeping track of tailored pieces for numerous unique joints. Since they are all the same, within the permitted tolerances, a workman need only take the next available key or polyhedra element and put it into the structure at the location of the next joint. Likewise, most of the polyhedra elements are preferably identical. Some of the polyhedra elements are necessarily modified, for example, to form openings or foundation engaging structure, but the angular relationships remain the same. The key elements can also be modified, where necessary or desirable, to accommodate openings or transitions in the form of the structure. Again, however, the angular relationships remain the same. Preferably, such special cases are few in number so they can be dealt with efficiently. The joint systems of the present invention are tolerant of the misalignments that inevitably occur in on-site construction projects. Also, the joints retain their strength and safety when the structures settle or foundations shift slightly as is normal with new construction.

Other objects, advantages, and novel features of the present invention will become apparent from the following detailed description of the invention when considered in conjunction with the accompanying drawings.

BRIEF DESCRIPTION OF THE DRAWINGS

The present invention provides its benefits across a broad spectrum of structures. While the description which follows hereinafter is meant to be representative of a number of such applications, it is not exhaustive. As those skilled in the art will recognize, the basic methods and apparatus taught herein can be readily adapted to many uses. It is applicant's intent that this specification and the claims appended hereto be accorded a breadth in keeping with the scope and spirit of the invention being disclosed despite what might appear to be limiting language imposed by the requirements of referring to the specific examples disclosed.

Referring particularly to the drawings for the purposes of illustration only and not limitation:

FIG. 11 is a plan view of one form of an inter-polyhedron embodiment of a joint system according to the present invention wherein three generally radially arrayed straight perpendicular slots in a triangular key element are slidably and rigidly engaged with one form of facet elements.

FIG. 12 is a three dimensional view of the joint system illustrated in FIG. 11.

FIG. 13 is an additional three dimensional view of the joint system illustrated in FIG. 11.

FIG. 14 is a further three dimensional view of the joint system illustrated in FIG. 11.

FIG. 15 is a three dimensional view of a truncated cuboctahedron with one facet identified. The same facet is identified in FIGS. 16, 17, and 18 so as to illustrate the location of this facet and its angular and spatial location relative to the other facets in the polyhedron.

FIG. 16 is a front view of the polyhedra illustrated in FIG. 15.

FIG. 17 is a side view of the polyhedra illustrated in FIG. 15.

FIG. 18 is a top view of the polyhedra illustrated in FIG. 15.

FIG. 19 is a plan view of a further embodiment of an inter-polyhedron joint system according to the present invention wherein each of the three polyhedra facet panels is illustrated as a full rectangle with four element engaging slots arrayed around its periphery.

FIG. 20 is a three dimensional view of the joint system illustrated in FIG. 19.

FIG. 21 is an additional three dimensional view of the joint system illustrated in FIG. 19.

FIG. 22 is a further three dimensional view of the joint system illustrated in FIG. 19.

FIG. 24 is a three dimensional view of a composite polyhedra construct composed of three different polyhedron forms joined together by an inter-polyhedron joint system of the present invention.

FIG. 25 is a three dimensional view of a composite construct composed of a plurality of different polyhedric forms including an inter-polyhedron joint system according to the present invention wherein the vertices of the polyhedra elements come to substantially a common point.

FIG. 28 is a plan view of a joint system according to the present invention wherein an extender or splice element has been utilized so the key member is not one solid panel.

FIG. 29 is a three dimensional view of the joint system illustrated in FIG. 28.

FIG. 39 is a plan view showing the planes of four mating key elements and an associated polyhedra element in an intra-polyhedron joint system according to the present invention.

FIG. 40 is a three dimensional view of the mating planes shown in FIG. 39.

FIG. 41 is another three dimensional view of the mating planes shown in FIG. 40.

FIG. 42 is a plan view showing a polyhedra element and four associated key elements in an intra-polyhedron joint system wherein the elements of the joint are joined without interpenetration.

FIG. 43 is a three dimensional view of the joint system of FIG. 42.

FIG. 44 is an additional three dimensional view of the joint system of FIG. 42.

DETAILED DESCRIPTION OF THE PREFERRED EMBODIMENTS

Figure 1:
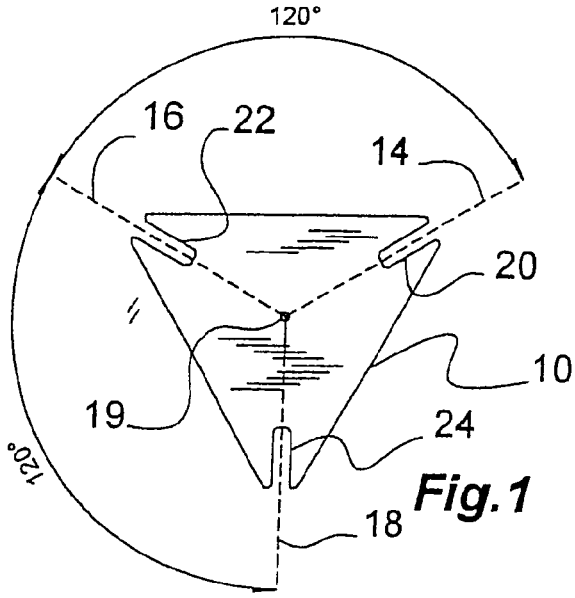
FIG. 1 is a plan view of one form of a key member according to the present invention illustrating the symmetrical array of radially extending joining slots in an inter-polyhedron embodiment of a joint system.
Figure 2:
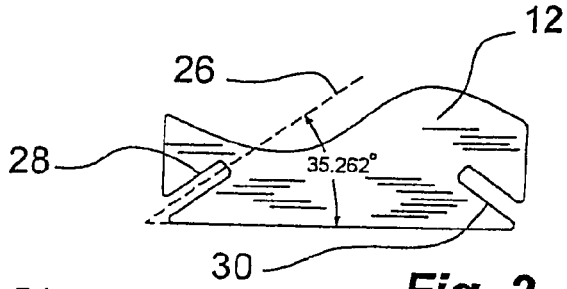
FIG. 2 is broken side view of one form of a facet element illustrating the angular relationship between the included edge of the element and the joining axis that lies in the plane of the facet element.
Figure 6:
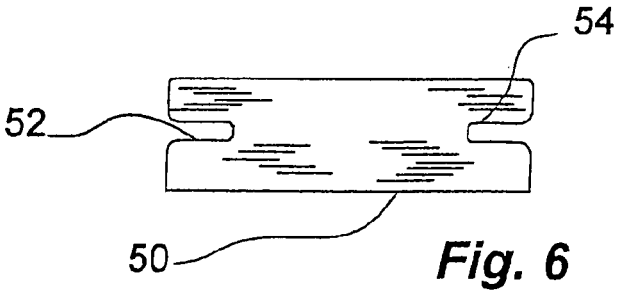
FIG. 6 is a side view of a key element extension or splice element.
Figure 5:
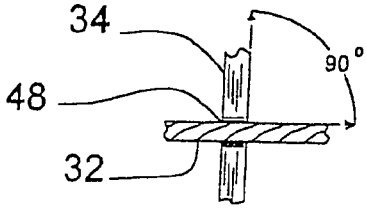
FIG. 5 is a cross-sectional view taken along line 5-5 in FIG. 4.
Figure 3:
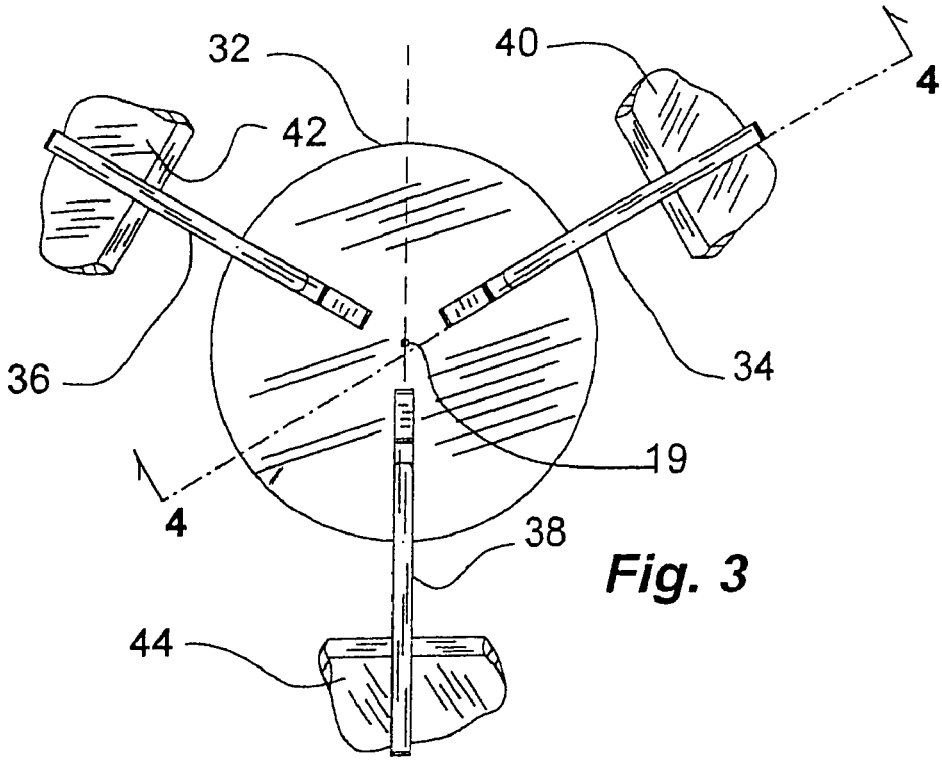
FIG. 3 is a plan view of an additional form of a key element assembled to mating facet elements in an inter-polyhedron embodiment of the present invention.
Figure 4:
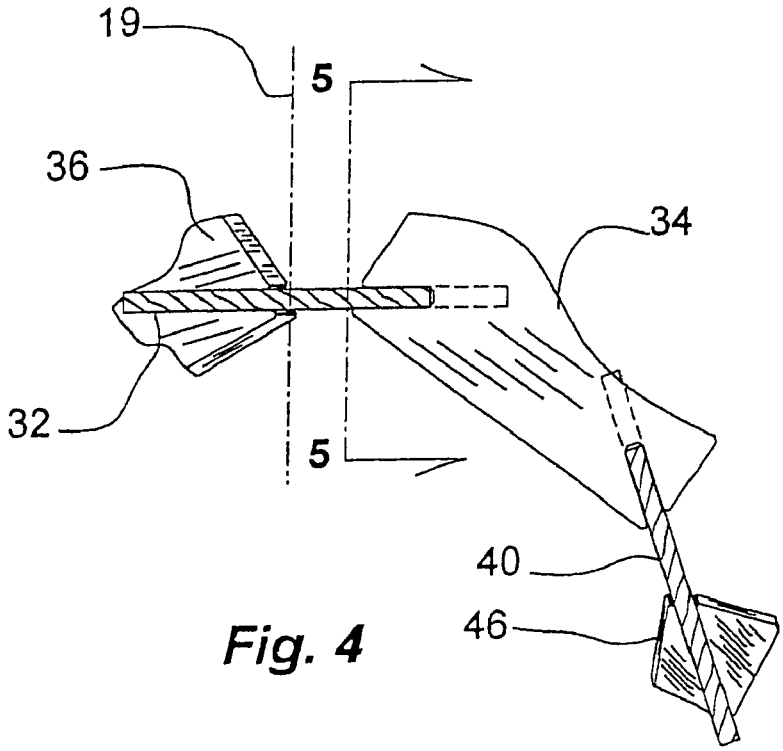
FIG. 4 is a cross-sectional view taken along line 4-4 in FIG. 3.
Figure 7:
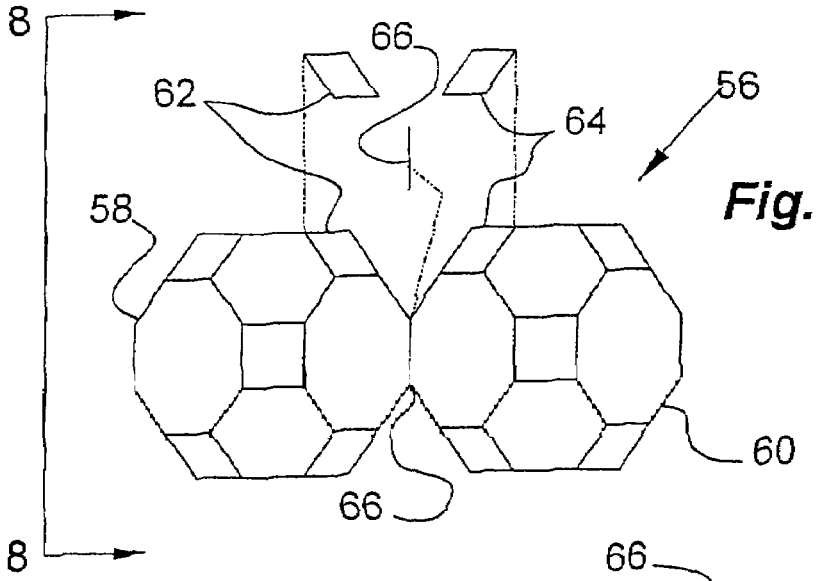
FIG. 7 is a front view of a composite polyhedral construct illustrating the location and angular relationships of three facet elements that are positioned to engage a key element (not shown) to form an inter-polyhedron embodiment of a joint system according to the present invention.
Figure 8:
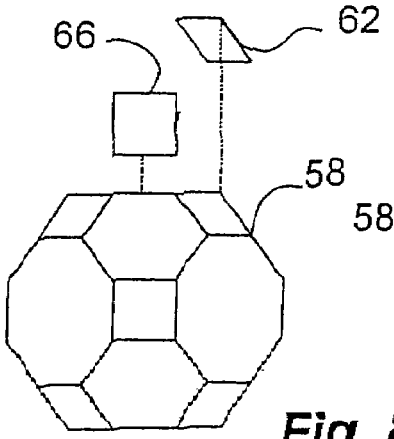
FIG. 8 is a side view taken along line 8-8 in FIG. 7.
Figure 9:
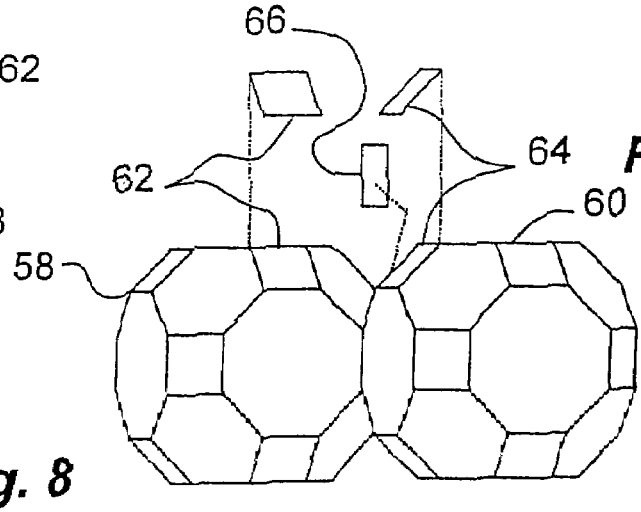
FIG. 9 is an angular front view of the construct illustrated in FIG. 7.
Figure 10:
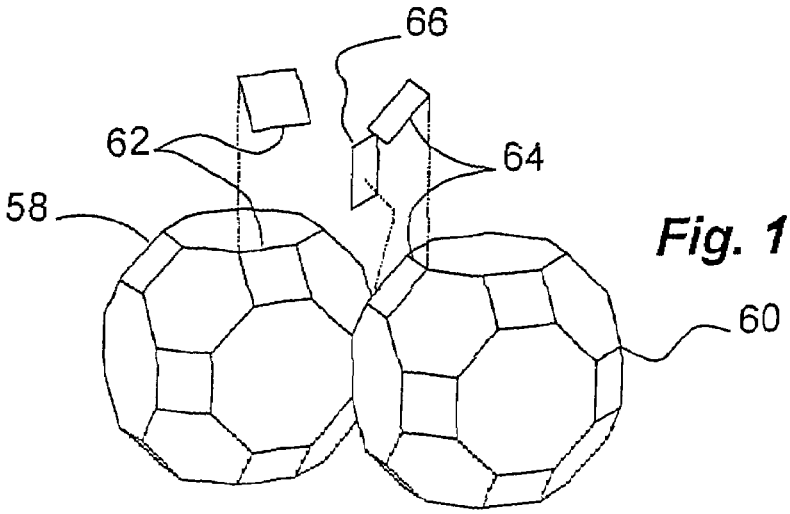
FIG. 10 is a three dimensional view of the construct illustrated in FIG. 7.

Referring now to the drawings wherein like reference numerals designate identical or corresponding parts throughout the several views, there is illustrated generally at 10 a key element for use in an inter-polyhedron joint system (FIG. 1). Key element 10 includes a key element axis 19 projecting generally perpendicularly from the plane of key element 10, and equally spaced joining axes (joining slot centerlines) 14, 16, and 18 arrayed generally radially around key element axis 19. Joining slots 20, 22, and 24 are aligned with the respective joining axes for sliding interengagement with, for example, slot 28 in facet element 12 (for clarity of illustration, facet element 12 in FIG. 2 is shown broken so that only two out of a possible four joining slots are shown). Key element 32 (FIG. 3) has a different peripheral profile from key element 10, but the same angular relationship exists between key element axis 19, the key element plane of key element 32, and the radially arrayed joining axes. Similarly, joint elements 34, 36, and 38 extend radially from and are equa-angularly spaced around axis 19. Taken together, joint elements 32, 34, 36, and 38 form a joint system for an inter-polyhedron joint system according to the present invention. Additional elements of the structure disposed in connected relationship generally radially around the joint system are shown at 40, 42, and 44 joined to their respective joining elements. As indicated particularly at 46 (FIG. 4), the structure continues to expand away from the joint system. The perpendicular nature of the juncture between joint element 34 and key element 32 is illustrated particularly in FIG. 5. The joint 48 is a slip joint where complimentary perpendicular slots are formed in each of the joint elements 32 and 34, and the joint elements interpenetrate one another in interengaging relationship to form the joint. Splice element 50 (FIG. 6) can be utilized to expand the size of a joint element (either a key element or a polyhedra element) without the use of a large panel. The opposed engaging slots 52 and 54 in splice element 50 extend generally along a common axis.

As indicated particularly in FIG. 2, slots 28 and 30 extend angularly of the joint element 12. The centerline 26 (polyhedra element joining axis) of slot 28 forms an angle of about 35.262 degrees with the included edge of joint element 12. Although this angle is given here with considerable accuracy, as will be understood by those skilled in the art, normal construction practices do not require that angular precision be maintained to several decimal places. The angular dimensions given herein are to be considered nominal with normal construction tolerances being permitted. Normal construction practices are acceptable in forming the joint systems according to the present invention. Slots 28 and 30 both extend at the same angle relative to the included edge of element 12 that extends between them. If extended until they meet slots 28 and 30 would form an isosceles triangle with the included edge of joint element 12. That isosceles triangle has an obtuse angle of about 109.5 degrees, and two acute angles of about 35.25 degrees each.

FIGS. 7 through 10 illustrate the locations of the facets, and the polyhedra elements (facet panels) that are generally congruent therewith, that serve as an in-polyhedron polyhedra joint elements in one preferred embodiment of the interpolyhedron joint system indicated generally at 56. The key element is not shown so as to permit the clear illustration of the three polyhedra elements. Truncated cuboctahedrons 58 and 60 are shown joined at a common vertical meridian facet 66 (facet 66 is an example of an embodiment of a common polyhedra joint element). Facets 62 and 64 are at fixed locations in their polyhedrons, 58 and 60, respectively. The polyhedra elements 62, 64, and 66 are shown exploded out of their respective facets but parallel with the positions that they occupy when congruent with those facets.

FIGS. 11 through 14 illustrate one embodiment of the inter-polyhedron joint system wherein a key element 10 of FIG. 1 is joined with partial polyhedra elements 68, 70, and 72. The illustrated inter-polyhedron joint system is formed by engaging interpenetrating slip joints. A first surface of key element 10 is indicated at 74, and the opposed second surface at 76. Each of the polyhedra elements 68, 70, and 72 is provided with a slot on one proximal corner, shown fully interengaged with a mating slot in key element 10, and a slot on the distal corner at 84, 78, and 82, respectively. The partial polyhedra elements are all substantially identical. The planes of the polyhedra elements all extend at about 90 degrees to the plane of key element 10. As shown, for example, in FIG. 12, the joint is assembled so that the slots 78, 82, and 84 on the remote or distal ends of the polyhedra elements all open in the same direction, generally toward side 74 of key member 10.

FIGS. 15 through 18 illustrate the location of a single facet 86 when the polyhedron in which it occurs is viewed from various angles. The illustrated polyhedron (truncated cuboctahedron) is in that family of polyhedrons where polyhedra elements are found that are useful as joint elements according to the present invention. The planes of the useful joint elements are generally congruent with the rectangular faces of this particular polyhedron. A polyhedral element having a plane generally congruent with facet 86 would be useful as a joint element according to the present invention.

FIGS. 19-22 illustrate a key element 96 assembled into an inter-polyhedron joint system with polyhedra elements 90, 92, and 94. The four illustrated joint elements 90, 92, 94, and 96 are configured to interengage and interpenetrate through mutual straight slots. Particularly as illustrated in FIG. 22, polyhedra element 90 is oriented in plan view to show the angular relationships in the system. The plane of key element 96 is generally perpendicular to the plane of polyhedra element 90. Joint element 90 has two polyhedra element axes extending generally perpendicular to the plane of this element. These two axes are indicated at 93 and 95. Slot centerlines 81 and 79 (polyhedra element joining axes) radiate from and intersect at axis 95. The angle between the polyhedra element joining axes 81 and 79, and the included edge of the joint element 90 is about 35.25 degrees. The angles indicated at 83, 85, and 97 are all about 35.25 degrees. Of necessity, because of the triangular nature of the geometry, the oblique included angle between the two centerlines at the vertex with the associated polyhedra axis is about 109.5 degrees. Although the edges of the joint elements have been indicated, for the sake of ease of illustration, as being straight, it will be understood by those skilled in the art that they may be concave, convex, sinusoidal, jagged, or the like, as may be desired. Where the joint edge between a pair of polyhedra element joining axes is other than straight, the base of the triangle between the axes that would be formed by a straight included element edge is considered to be a virtual straight edge. All of the joint elements 90, 92, and 94 are identical. They can be produced at a factory location, where close quality control is exercised, and transported to a construction site for quick accurate assembly. It is much easier to exercise quality control at a factory than on a construction site so factory production permits faster construction and a higher quality finished construct.

Figure 23:
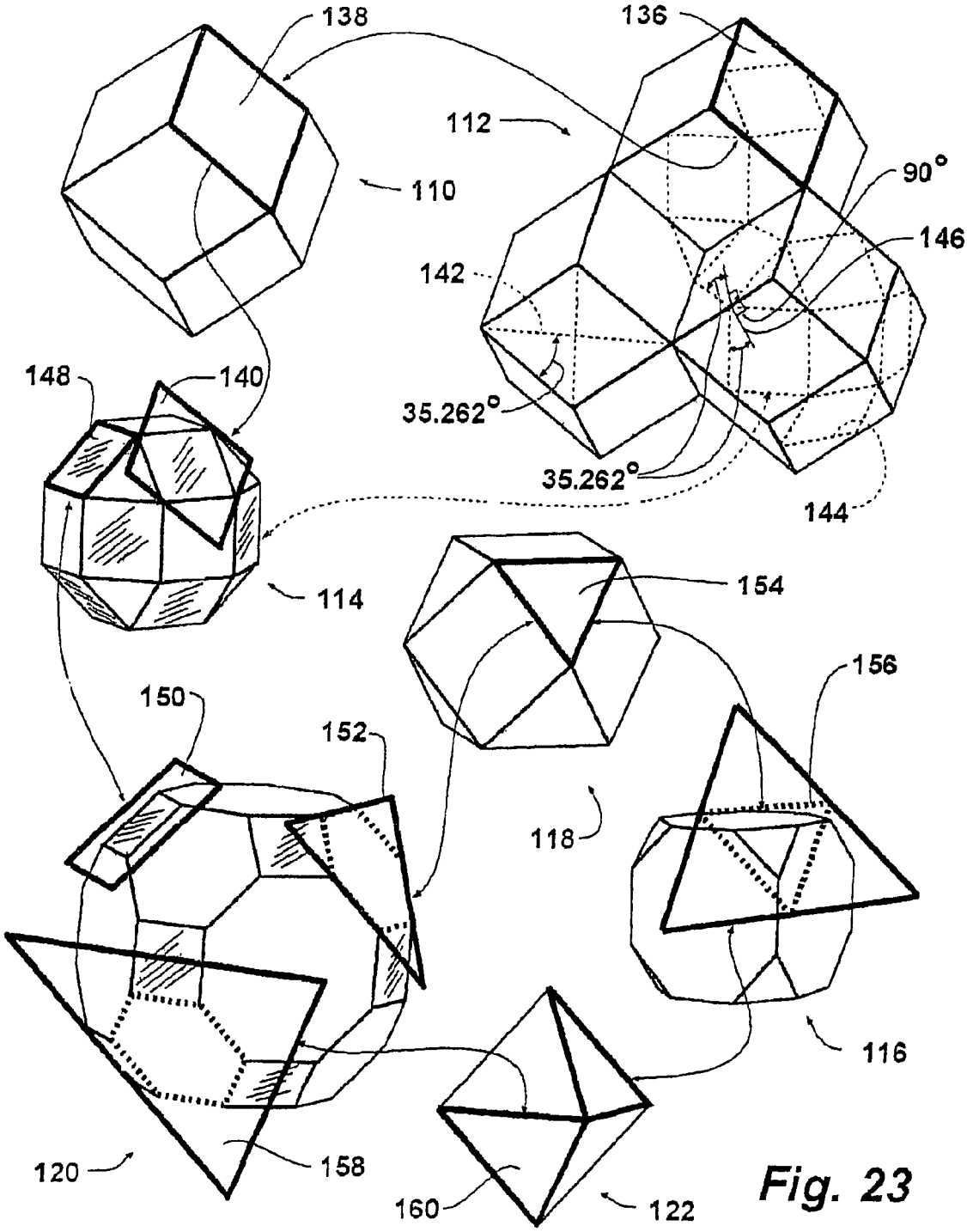
FIG. 23 illustrates with three dimensional views how the truncation of the vertices of various polyhedron forms generates different polyhedron forms to which the various embodiments of the joint structures according to the present invention are applicable.

FIG. 23 illustrates some members of the families of polyhedrons with which the inter- and intra-polyhedron joint systems according to the present invention are useful. It is apparent from FIG. 23 how various polyhedrons, by truncating their vertices, can be morphed into other polyhedrons. The truncation of the eight vertices of a cube produces the truncated cube 116. Further truncation of the truncated cube 116, until the vertices of the adjacent triangular facets meet, produces cuboctahedron 118. The six octagonal facets in truncated cube 116 become rectangles while the triangular facets remain triangular in cuboctahedron 118. The plane of facet 156 is parallel with that of facet 154. If the angle of the plane is maintained and facet 156 is expanded further to the point where the edges of adjacent triangular facets meet and all of the vertices of the triangular pieces meet at a common point, the octahedron 122 is generated. One of the facets of the octahedron 122 would be parallel to facets 156 and 154. The rombic doedecahedron 110 can be assembled with other rombic dodecahedrons to form, for example, the composite multicelled structure 112. The diamond shaped facet 136 in structure 112 corresponds to facet 138 in rombic dodecahedron 110 and plane 140 in rhombicuboctahedron 114. Truncation of the vertices of rombic dodecahedron 110 generates rhombicuboctahedron 114. Facet 138 morphs into the rectangular facet that is congruent with plane 140 as the vertices of polyhedron 110 are truncated to produce polyhedron 114. Polyhedron 114 includes 18 rectangular facets. Six of the rectangular facets have triangular facets off of each corner. Twelve of the rectangular facets, of which 148 is typical, have rectangular facets off of each corner. The six rectangular facets in polyhedron 114 that have triangles off of their corners become octagonal when polyhedron 114 is expands (morphs) into truncated cuboctahedron (great rhombicuboctahedron) 120. The other twelve rectangular facets remain rectangles when polyhedron 114 morphs into truncated cuboctahedron 120, as indicated at 150. When cuboctahedron 118 is truncated and morphs into truncated cuboctahedron 120, the triangular facet 154 becomes hexagonal as indicated by the dotted facet outline congruent with triangle 152. When octahedron 122 is doubly truncated so as to morph into truncated cuboctahedron 120 the triangular facets, such as 160 morph into hexagonal facets as indicated by the dotted outline of a hexagonal facet congruent with triangle 158. Phantom lines 144 in composite structure 112 indicate how the structure would look if several cells of the rhombicuboctahedron 114 were to be assembled into the same space as the rhombic dodecahedron composite 112. The morphing effect of the truncation of the vertices of rhombic dodecahedron 110 is evident from a comparison of the solid and phantom lines in composite 112. Line 146 is in the plane of a facet of the rhombic dodecahedron, and it extends at right angles to the edge of that facet as indicated. The approximate 35.25 degree angle, measured at a vertex of the rhombicuboctahedron, between line 146 and the edge of the rhombicuboctahedron 114 that is formed by truncating the rhombic dodecahedron is indicated. As indicated in the adjacent facet, a corresponding angular relationship between the rhombic dodecahedron and the rhombicuboctahedron produced by truncation exists in the other facets. This is the same angle that is observed, for example, in joining polyhedra element 90 in FIG. 22 with key element 96 so as to obtain perpendicularity in that connection.

FIG. 24 is illustrative of a composite polyhedron structure composed of several different polyhedron forms. One inter-polyhedron joint system is illustrated between two great rombicuboctahedrons, one of which is indicated at 124. See also FIGS. 7 through 10 for an understanding of the positioning of these two polyhedrons and the polyhedra elements therein. The invisible facets of the various polyhedron forms are indicated in hidden lines, for example, at 178. A truncated cube is joined at a common octagonal facet to a mating octagonal facet in great rombicuboctahedron 124. Two other truncated cubes are likewise joined to the top octagonal facets of the respective great rombicuboctahedrons. The orientation of the respective truncated cubes is evident from the fact that the triangular facets 162, 166, and 168 are all parallel to one another. A truncated tetrahedron 128 is positioned between the two upper truncated cubes and engaged to the truncated cubes through common mating triangular facets. Rectangular polyhedra element 66 is located at the common facet where the great rombicuboctahedrons are joined to one another, and polyhedra elements 62 and 64 are located in the respective great rombicuboctahedrons. One facet of a second truncated tetrahedron is indicated at 164. Preferably, a key element somewhat larger than 164 is positioned between and perpendicularly with respect to polyhedra elements 62, 64, and 66. Preferably the key element is sized so that it interengages and interpenetrates with the other three joint elements, 62, 64, and 66.

The truncated cube 126 shown in FIG. 24 includes triangular facets 162, 161, and 165. Triangular facets 162 and 161 are joined by edge 163, and triangular facet 162 is joined to triangular facet 165 by edge 167. The four triangular facets on the facing side of cube 126 and the respective edges that join them together define the edges of an octagon. The joint structure illustrated in FIGS. 11 through 14 is particularly well suited to forming the truncated cube structure shown in FIG. 24, because the angle between the polyhedra element joining axes and the included edge of the triangular polyhedra element 162 is about 35.5 degrees. The facet 162, for example, corresponds to key element 10 in FIGS. 11-14, and the edges 159, 163 and 167 in the truncated cube 126 correspond to partial polyhedra elements 68, 70, and 72. Facets 161 and 165 also have the same form and angular positioning with respect to the edges as does facet 162. The partial polyhedra elements 68, 70, and 72 serve in this embodiment to join the key elements together. Thus, the joint structure of FIGS. 11-14, with the partial polyhedra elements 68, 70, and 72 is adapted for use as an intra-polyhedron joint in a truncated cube.

The truncated tetrahedron 128 in the composite structure in FIG. 24 has a triangular facet 171. Triangular facet 171 is joined corner-to-corner through edges 169 and 173 to other triangular facets in polyhedron 128. The edges of the triangular facets together with the edges between the triangular facets define the edges of hexagonal facets. The intra-polyhedron joint structure here in truncated tetrahedron 128 is similar to that described with respect to the truncated cube 126 except that the angle between the polyhedra joining axes and the included edge of the triangular polyhedra element 171 is about 54.75 instead of 35.25 degrees. The corner-to-corner joinder of the respective triangular facets through perpendicular edge elements at the associated edges thus generates a hexagonal facet in truncated tetrahedron 128, and an octagonal facet in truncated cube 126.

FIG. 25 is illustrative of a composite composed of different polyhedrons including cubes of which 134 is typical, rhombicuboctahedrons of which 130 is typical, and a tetrahedron 132. The rhombicuboctahedrons are joined together through a four element joint system composed of polyhedra elements 170, 174, and 172, and a triangular shaped key element that, for reasons of clarity, is not shown. The joint elements 170 and 172 interpenetrate the key element so that they substantially meet at the key element axis. Hidden lines, of which 176 is typical, indicate the hidden edges of the composite structure depicted in FIG. 25. According to one preferred embodiment of the present invention, the intra-polyhedron joints within the rhombicuboctahedrons in FIG. 25 and the great rhombicuboctahedrons in FIG. 24 are formed by three joint elements (two polyhedra elements and a key element) according to the present invention, and alternate facets are left open. This repeatable three element joint structure provides the necessary structural strength while offering many aesthetic and functional options by reason of the alternate open facets.

Figure 26:
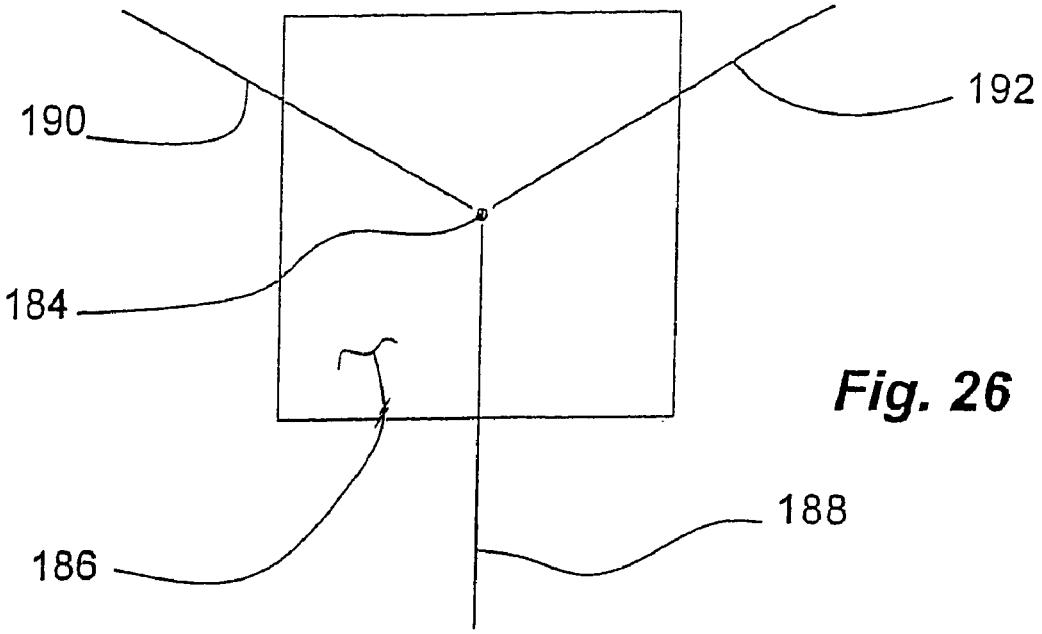
FIG. 26 is a plan view of the four planes and the key axis that are present in an inter-polyhedron embodiment of a joint system according to the present invention.
Figure 27:
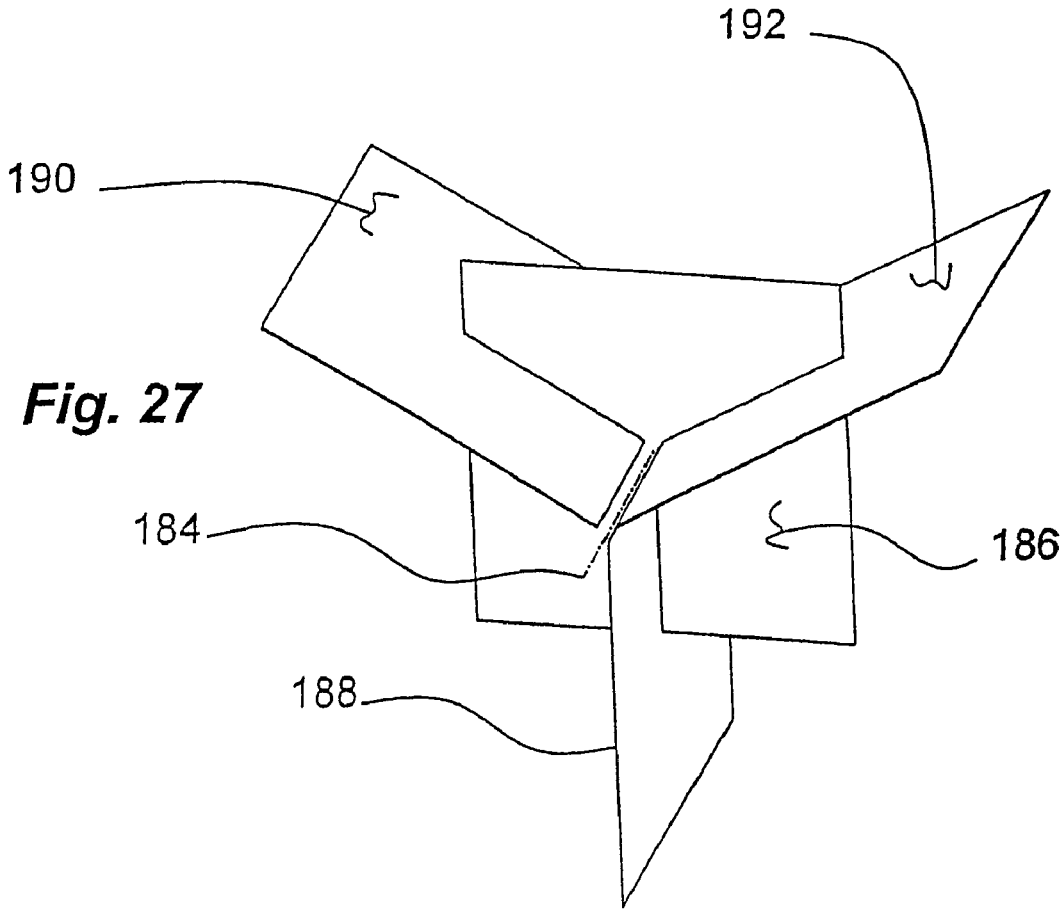
FIG. 27 is a three dimensional view of the planes and axis illustrated in FIG. 26.

FIGS. 26 and 27 illustrate the planes that occur in the four element inter-polyhedron joint systems according to the present invention. The plane 186 of the key element extends generally perpendicular to the planes 188, 190, and 192, respectively, of the other three joint elements (polyhedra elements). The planes of the polyhedra elements all project radially from and equa-angularly spaced around key element axis 184.

FIGS. 28 and 29 illustrate the expansion of a joint element. In these FIGS., the size of key element 96 is expanded by use of splints or splice elements 196 and 198. Such expansion may be desirable for weight or aesthetic purposes. Elements 196 and 198 are similar to splice element 50 of FIG. 6. The polyhedra element 90 and the key element 96 are similar to those in the embodiment illustrated in FIGS. 19 through 22. The splint or splice elements are substantially identical to one another. The various elements in the joint are slidably interengaged by means of straight slots.

Figure 30:
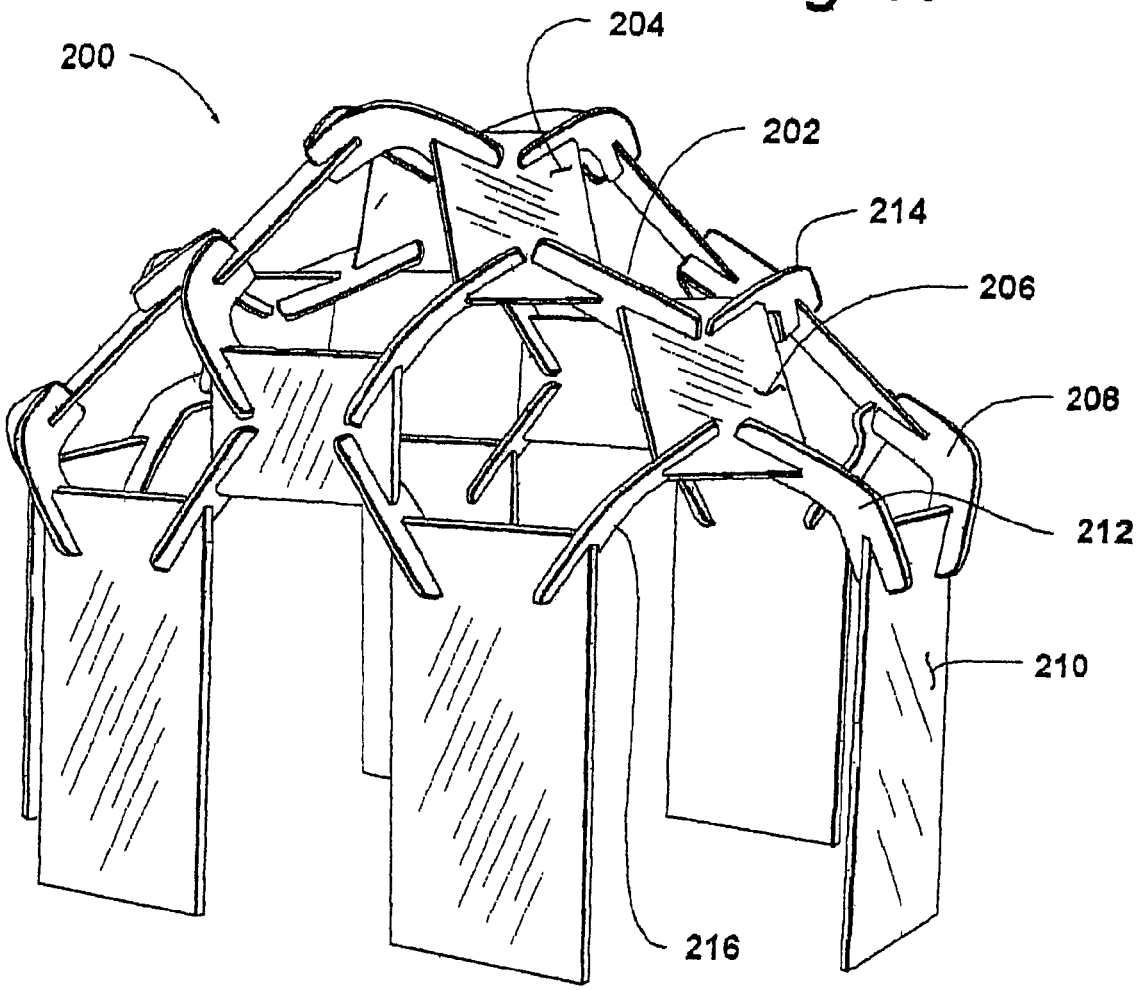
FIG. 30 is a three dimensional view of a polyhedron wherein the polyhedra elements are joined together through intra-polyhedron embodiments of a joint system according to the present invention, and a splice element is utilized to expand a facet of the polyhedron.

FIG. 30 illustrates a polyhedric structure 200, which has been stretched along one axis to form a rectangular floor plan. In polyhedric structure 200 the inter-facet joints are formed utilizing a three element intra-polyhedron joint system according to the present invention. For example, a three element joint is composed of polyhedra element 206, key element 212, and polyhedra element 210. The branching nature of the polyhedric structure joined by such three element joints is shown by the fact that key element 208 forms a second joint with joint element 210. Likewise, key element 214 forms a second joint with joint element 206. Likewise, key element 216 forms a third joint with joint element 206. The facet in which elements 206 and 204 are located is rendered as open as possible by reason of the use of a splice element 202 between joint elements 204 and 206. This use of a splice element in one direction also allows the stretching of the polyhedric form to provide a rectangular floor plan. The use of splice elements allows the shape of a facet to be changed as desired. Splice element 202 occupies the location that would be occupied by a fourth key element if the joint element 206 were generally co-extensive with the facet in which it occurs. That is, in this embodiment joint element 206 is congruent with but not co-extensive with the facet in which it is located. The joint elements, of which 210 is typical, are extended and serve as walls or base members upon which the polyhedric structure rests.

Figure 31:
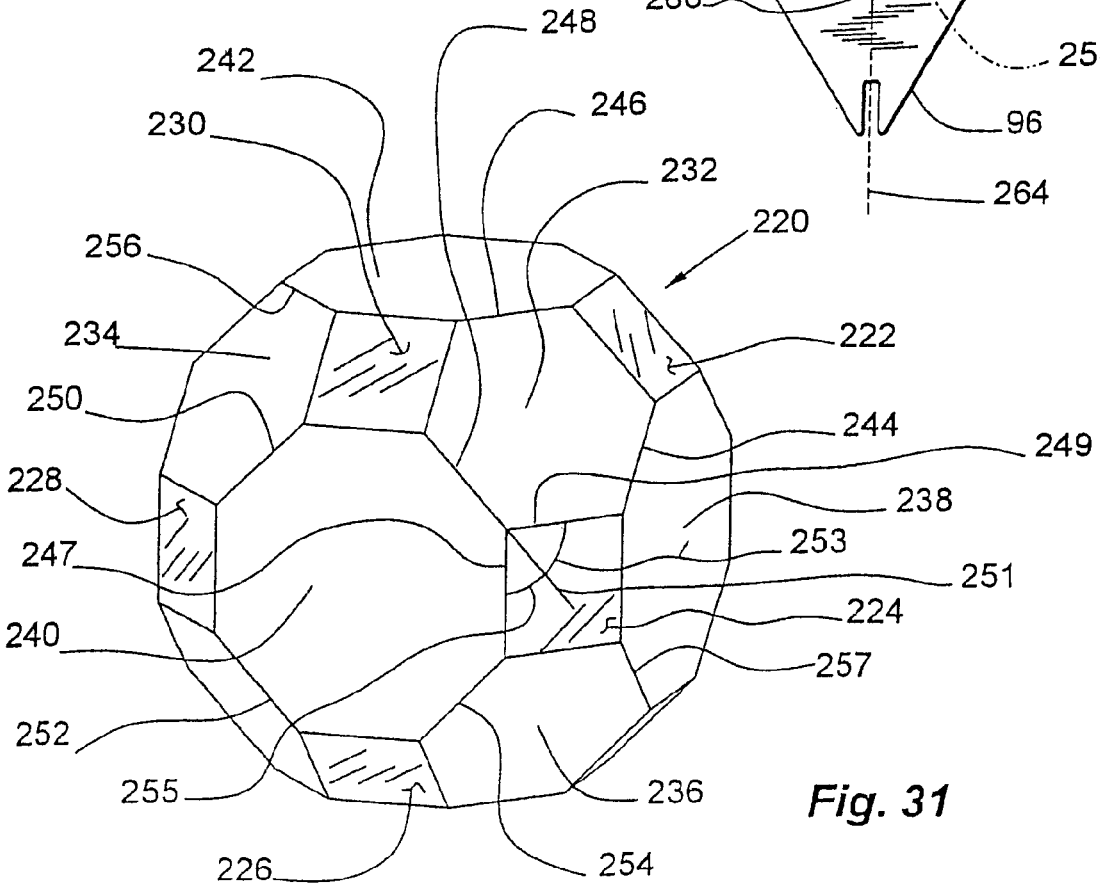
FIG. 31 is a three dimensional view of a truncated cuboctahedron wherein the octagonal and hexagonal facets are open, the square facets are solid panels, and intra-polyhedron key elements are employed to assemble the solid panels together.

FIG. 31 illustrates in some additional detail where intra-polyhedron joint systems of the present invention are advantageously employed in a polyhedron, for example, a truncated cuboctahedron (great rombicuboctahedron) 220. The only solid panels in polyhedric form 220 are the rectangular panels 222, 224, 226, 228, 230, and the corresponding hidden rectangular facet panels. The hexagonal areas of which 232, 236, and 234 are typical are open, as are the octagonal areas of which 238, 240 and 242 are typical. The edges between the octagonal and hexagonal areas, of which 244, 246, 248, 250, 252, 254, 256, and 257 are typical, are formed by the key elements or members in three element intra-polyhedron joint systems. Open hexagonal area 232, for example, is bounded by the edges of rectangular panels 222, 224, and 230, and by the key elements 244, 246, and 248. Since the key elements extend generally perpendicular to the planes of the solid panels, they provide structural strength while not intruding into the open facets. The orientation of the key element plane relative to the polyhedra element is such, for example, in polyhedra element 224 of FIG. 31, that the angle between the plane of key element 248 and the included edge 247 of polyhedra element 224 that bounds octagonal opening 240 is about 35.25 degrees. The key element joining axis for key element 248 and the associated polyhedra element joining axis for polyhedra element 224 are congruent as indicated at 251. The angle 255 between the congruent axes 251 and the included edge 247 is about 35.25 degrees. The angle 253 between the plane of key element 248 and the adjacent edge 249 of polyhedra element 224 that bounds open hexagonal facet 232 and is about 54.75 degrees. Despite the size and complexity of form 220, it is composed of only two repeating elements, namely, rectangular panels, and key elements. The rectangular panels are all substantially identical. The key elements are likewise substantially all identical. The entire structure can be made at a fixed factory location using only two templates or machine setups. Semi-skilled workers can very quickly accomplish the assembly of the prefabricated polyhedron elements at a construction site. Typically, some base elements (not shown) are employed to anchor the structure to a foundation, but these few non-standard base parts can also be made at a factory site.

Figure 33:
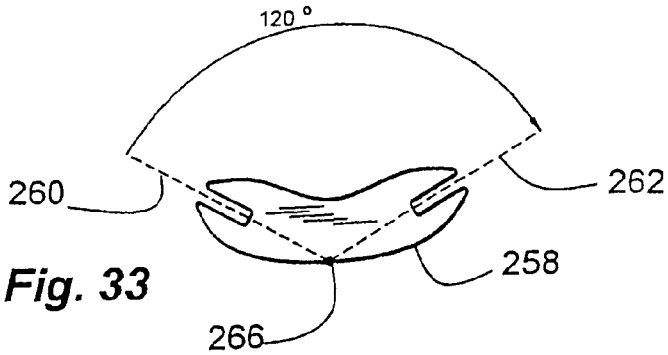
FIG. 33 is a plan view of the intra-polyhedron key element illustrated in FIG. 32.
Figure 32:
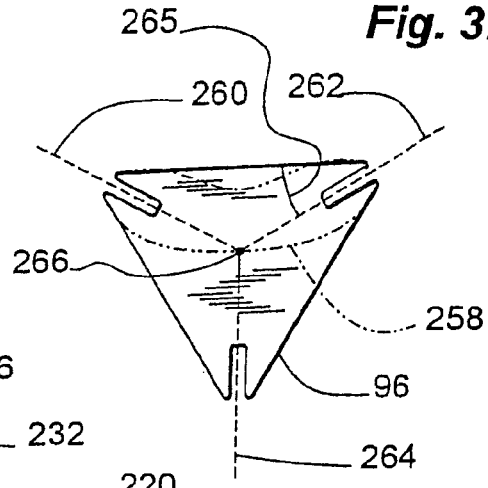
FIG. 32 is a plan view in phantom lines of an intra-polyhedron key element superimposed on an inter-polyhedron key element to illustrate the relationship between the two embodiments of a key element according to the present invention.

FIGS. 32 and 33 illustrates the relationship between the key elements for the three and four element joint system embodiments. Key element 96 is intended for use in a four element inter-polyhedron joint system. Key element 258 is particularly suited for use in a three element intra-polyhedron joint system embodiment such as that shown in FIG. 31. In FIG. 32 the key element 258 is shown in phantom lines superimposed on key element 96. The angular relationships are the same in both embodiments. The centerlines (joining axes) 260 and 262 of the engaging slots are radially disposed around key element axis 266 at an included angle of 120 degrees in both embodiments. The third joining axis 264 is not present in the embodiment represented by key element 258. The angular relationship indicated, for example, at 265 (about 30 degrees) between the joining axes 262 and 260 with the included edge of the key element is the same even though the included edge in key element 258 is virtual by reason of the actual edge being curved. When assembled, axis 262 is congruent with a mating joining axis in an associated polyhedra element such as shown at 251 in FIG. 31.

Figure 34:
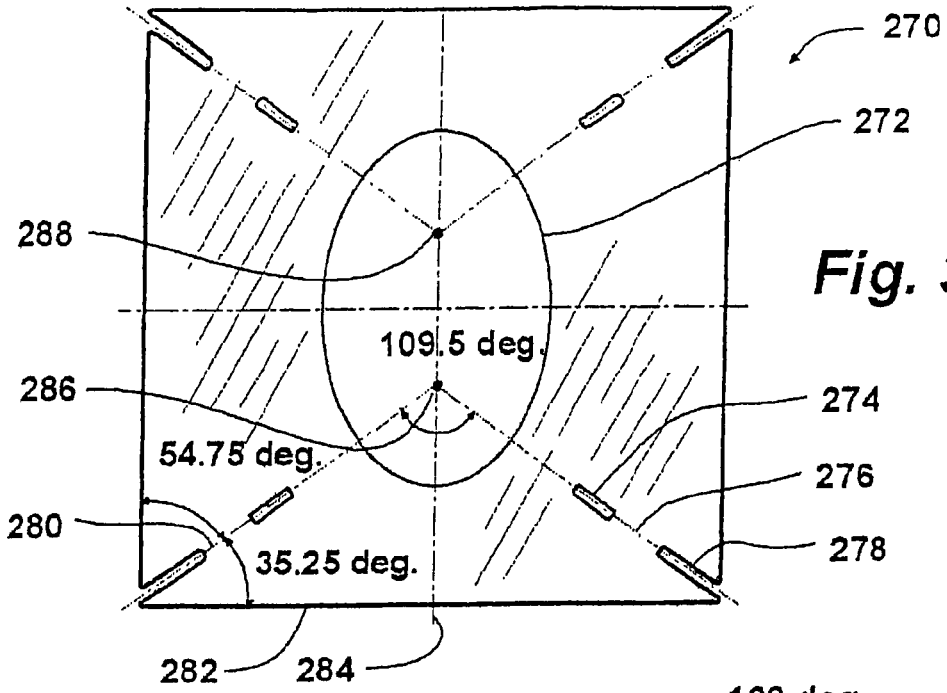
FIG. 34 is a plan view of a polyhedra element suitable for use, according to the present invention, in an inter- or intra-polyhedron joint system.
Figure 35:
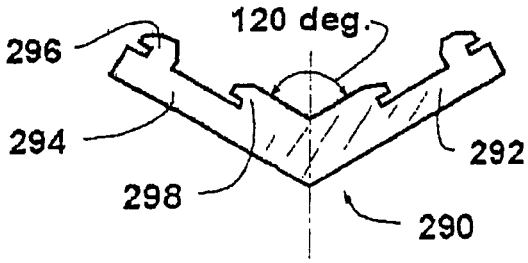
FIG. 35 is a plan view of a key element for use, according to the present invention, in an intra-polyhedron joint system where interengagement between the respective joint elements is accomplished by inserting and sliding hooked key tabs into mating closed or open openings in the polyhedra element.
Figure 36:
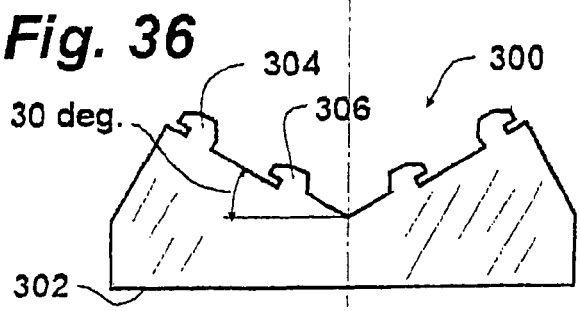
FIG. 36 is a plan view of a modified key element for use, according to the present invention, as a base member in an intra-polyhedron joint system.
Figure 37:
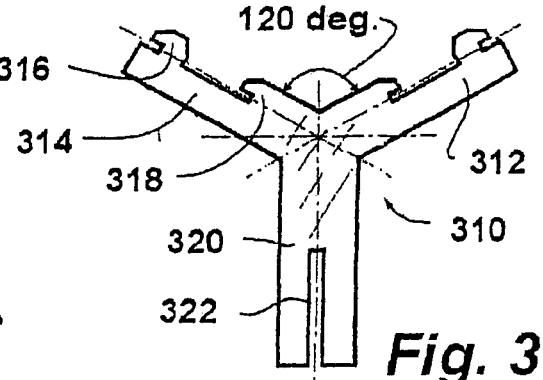
FIG. 37 is a plan view of a modified key element for use, according to the present invention, in an inter-polyhedron joint system where one joint is formed by slidably engaging mating slots in the key element and the polyhedra element, and the other joints are formed through hooked engaging elements.
Figure 38:
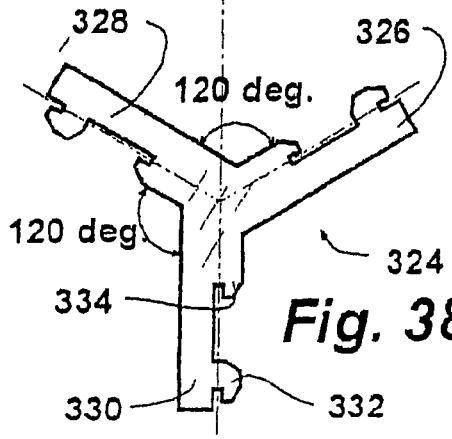
FIG. 38 is a plan view of a modified key element for use, according to the present invention, in inter-polyhedron joint systems.

FIG. 34 is illustrative of a panel 270 that is useful as a polyhedra element in a three or four element intra- or inter-polyhedron joint system. An oval opening 272 is provided in the middle of the otherwise solid panel 270 so as to lighten the structure. Opening 272 may also serve an aesthetic function. The panel 270 is adapted to be joined, for example, to the key elements shown in FIGS. 35 through 38. The joints are formed by inserting the hooked tabs on the key elements into openings in the polyhedra element, and sliding the joint elements laterally of one another for a short distance. In panel 270 typical polyhedra element joining axes 276 and 280 radiate from polyhedra element axis 286 at an oblique included angle of about 109.5 degrees. Included edge 282 is provided to indicate the angular relationships in the isosceles triangle formed by the axes 276 and 280 with included edge 282. A second set of polyhedra element joining axes and associated joining features are indicated radiating from polyhedra element axis 288. Axes 286 and 288 are aligned along one planar axis 284 of panel 270. Planar axis 284 extends generally perpendicular to the joint element axes 286 and 288. Joinder is accomplished with a minimum amount of relative sliding motion between the respective joint elements by providing an open straight slot of which 278 is typical and a closed straight slot of which 274 is typical. Mating hooked tabs 296 and 298 are provided on arm 294 of key element 290 (FIG. 35). Key element 290 is positioned, for example, so that hooked tab 296 passes through closed slot 274 and hooked tab 298 passes through slot 278. When the hooked tabs are fully inserted into the associated slots, the key member 290 is slidably engaged with the panel 270 by sliding the key member 290 in its own plane to seat the hooks in the slots. The hooks serve as fastening members and only the hooks project through the panel 270. With hook tabs 296 and 298 fully engaged with panel 270 the panel rests on the edge of key element arm 294 that extends between the hook tabs. A second panel of the same or different form can likewise be engaged with the hook tabs in key element arm 292. Key element 300 in FIG. 36 has been modified to form a base member. Bottom edge 302 is adapted to rest on a foundation. Hook tabs 304 and 306 are adapted to be engaged with open and closed slots in a polyhedra element as described, for example, with reference to FIGS. 34 and 35. Assembly is simplified as compared with the embodiment of, for example, FIG. 30 because the panels do not have to travel slidably for such long distances to fully engage the joint elements. FIGS. 37 and 38 illustrate a tabbed hook fastening embodiment as applied to four element inter-polyhedron joint systems. Key element 310 in FIG. 37 is a hybrid of two fastening arrangements. Key element arms 314 and 312 are provided with hooked tabs 316 and 318 similar to the embodiments of FIGS. 35 and 36. The third key element leg 320 is provided with a slot 322 that is intended to slidably engage a straight slot in a polyhedra element by sliding engagement. In the embodiment of FIG. 38 the key element arms 326, 328, and 330 of key element 324 are provided with hooked tabs of which 332 and 334 are typical. The hooked tabs are on rotationally opposed edges of the respective arms. This accommodates rotational positioning during assembly, which allows assembly with a minimum of movement.

FIGS. 39 through 41 are illustrative of the relationships between the polyhedra element planes in three member intra-polyhedron joint systems. The rectangular polyhedra element plane 340 has two polyhedra element axes 350 and 352 extending generally normal thereto. Key element planes 342 and 344 extend radially of axis 350 in the angular relationships previously described with reference, for example, to FIGS. 19 through 22, and 34. Likewise, key element planes 348 and 346 extend radially of axis 352.

FIG. 42 through FIG. 44 illustrate the use of formed key elements 366, 368, 370, and 374 that are joined by other than slotted arrangements to a polyhedra joint element 360. These formed key elements are, for example, extruded hollow metal sections. Such extruded section key elements exhibit the desirable properties of substantial strength and light weight. Such extruded sections observe the same angular relationships as described previously with respect, for example, to FIGS. 31 through 33, and 39 through 40. Key element 366 is suitable, for example, for use as key element 248 in FIG. 31. Fastening arrangements such as glue, spot welds, screws, bolts, rivets (see 376), or the like, can be employed to secure the hollow extruded key elements 366, 368, 370, and 374 to the mating joint element 360. The key elements are positioned entirely on one side of the joint element 360. This can be advantageous for aesthetic or utilitarian purposes.

What have been described are preferred embodiments in which modifications and changes may be made without departing from the spirit and scope of the accompanying claims. Clearly, many modifications and variations of the present invention are possible in light of the above teachings. It is therefore to be understood that, within the scope of the appended claims, the invention may be practiced otherwise than as specifically described.

What is claimed is:

1. A joint system for a composite construct composed of at least two polyhedric cells, said joint system securing said two polyhedric cells together, said two polyhedric cells having a plurality of facets and sharing a common facet, said joint system comprising:

a key element having a key axis and a key plane, said key axis extending generally perpendicular to said key plane, first, second, and third key joining axes extending generally within said key plane, said key joining axes being arrayed generally radially of said key axis and generally equally angularly spaced from one another around said key axis;

a common polyhedra joint element having a common plane generally congruent with said common facet, said common plane extending generally perpendicular to said key plane and including a common joining axis extending generally within said common plane;

a first polyhedra joint element having a first polyhedra plane generally congruent with a first facet of a first of said two polyhedric cells, said first polyhedra plane extending generally perpendicular to said key plane and including a first joining axis extending generally within said first polyhedra plane; and a second polyhedra joint element having a second polyhedra plane generally congruent with a second facet of a second of said two polyhedric cells, said second polyhedra plane extending generally perpendicular to said key plane and including a second joining axis extending generally within said second polyhedra plane, said first, second, and third key axis extending generally congruently with said common, first, and second joining axis, respectively.

2. A joint system of claim 1 wherein said two polyhedric cells have substantially the same polyhedric form.

3. A joint system of claim 1 wherein said two polyhedric cells have different polyhedric forms.

4. A joint system of claim 1 wherein at least one of said polyhedric cells has a rombic dodecahedron form.

5. A joint system of claim 1 wherein at least one of said polyhedric cells has a truncated cuboctahedron form.

6. A joint system of claim 1 including first, second, and third key slots extending generally perpendicularly through said key element and generally aligned with said first, second, and third key joining axes, respectively, and said common, first, and second joining slots extending generally perpendicularly through said respective common, first, and second polyhedra joint elements, and generally aligned with said common, first, and second joining axes, said common, first, and second joining slots being slidably interengaged with said first, second, and third key slots, respectively.

7. A joint system of claim 1 wherein said polyhedra joint elements and said key element are slidably interengaged through complementary straight slots.

8. A joint system of claim 1 wherein said plurality of facets include open facets and closed facets.

9. A joint system of claim 1 wherein said key element and said polyhedra joint elements comprise generally flat panel members.

10. A joint system for joining polyhedric facet elements together comprising at least:

a first polyhedric facet element having a first facet plane;

a second polyhedric facet element having a second facet plane, said first and second facet planes being non-congruent;

a third polyhedric facet element, said third polyhedric facet element sharing said first facet plane with said first polyhedric facet element;

a splice element in engagement with and extending between said first and third polyhedric elements; and a key element disposed between said first and second polyhedric facet elements and having a key element plane and a key axis, said key element plane extending generally perpendicular to each of said first and second polyhedric facet element planes, and said first and second polyhedric facet elements extending at an included angle of approximately 120 degrees to one another and radially from said key axis.

11. A joint system of claim 10 wherein said first and second polyhedric facet elements are in the same polyhedron.

12. A joint system of claim 10 wherein said first and second polyhedric facet elements are in different polyhedrons.

13. A joint system of claim 10 wherein said first and second polyhedric facet elements comprise generally flat panel members.

14. A joint system of claim 10 wherein said first and second polyhedric facet elements and said key element are slidably interengaged through complimentary straight slots.

15. A joint system of claim 10 wherein said first and second polyhedric facet elements and said key element are intergaged without interpenetration

16. A joint system of claim 10 wherein said first and second polyhedric facet elements and said key element are interengaged through additional fastening elements.

* * * * *

UNITED STATES PATENT AND TRADEMARK OFFICE

CERTIFICATE OF CORRECTION

PATENT NO. : 7,662,014 B2
APPLICATION NO. : 10/741480
DATED : February 16, 2010
INVENTOR(S) : Gregg R. Fleishman It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1725 days.

Signed and Sealed this

Twenty-eighth Day of December, 2010

David J. Kappos

David J. Kappos
*Director of the United States Patent and Trademark Office*